US007992874B1

(12) United States Patent
Davidson

(10) Patent No.: US 7,992,874 B1
(45) Date of Patent: Aug. 9, 2011

(54) DART RACING GAME

(76) Inventor: Daryl Davidson, Billings, MT (US)

( * ) Notice: Subject to any disclaimer, the term of this patent is extended or adjusted under 35 U.S.C. 154(b) by 71 days.

(21) Appl. No.: 12/586,577

(22) Filed: Sep. 25, 2009

(51) Int. Cl.
*F41J 3/00* (2006.01)

(52) U.S. Cl. ..... 273/408; 273/409

(58) Field of Classification Search ..... 273/371–377, 273/246, 403–410, 441, 442
See application file for complete search history.

(56) References Cited

U.S. PATENT DOCUMENTS 1,148,737 A * 8/1915 Atkins ..... 273/246
3,044,779 A * 7/1962 Hvizdash ..... 273/246
3,853,318 A 12/1974 Cagan
3,979,117 A 9/1976 Worsham
5,005,842 A 4/1991 Bauer
D329,469 S 9/1992 Franklin et al.
5,642,886 A 7/1997 Yancey et al.
5,743,534 A 4/1998 Pan
5,967,518 A 10/1999 Rowe
6,105,965 A * 8/2000 Perry ..... 273/348.3
D491,612 S 6/2004 Tournillon
7,470,186 B2 * 12/2008 Cannon ..... 463/18

* cited by examiner

*Primary Examiner* — Mark S Graham
(74) *Attorney, Agent, or Firm* — Paul R. Martin

(57) ABSTRACT

A dart game simulates an automobile race, such as NASCAR or INDYCAR. The players throw darts at a target board and follow instructions in areas of the target board according to where the dart landed. Each of the players has a game piece that is located on a scoreboard that is shaped to simulate a race track and is divided into a plurality of steps. The target board is also divided into a pit area. Each game piece is moved in accordance with the instructions found on the target board. A player can move in the track area only if his game piece is permitted on the track. A game piece is removed from the track if the player strikes an area on the target board that contains instructions which require the game piece to be moved into the pit. The player can only exit the pit if he has struck an area that has instructions that permit him to move out of the pits. The game continues until one player has completed a preset number of laps and crosses a start/finish line first.

12 Claims, 4 Drawing Sheets

DART RACING GAME

TECHNICAL FIELD OF THE INVENTION

The present invention relates to the general art of games, and to the particular field of darts.

BACKGROUND OF THE INVENTION

Conventional darts is generally are played in a manner of setting scores according to the hit positions on the target. The used target generally has a certain pattern on the surface thereof and can only provide a single and simple game mode. With the needs of improving enjoyment of the games, this kind of darts game has become boring and unsatisfactory.

Various games employing darts have enjoyed considerable popularity with bar patrons and league players as relaxing, competitive games which can be played while socializing. Recently, there has also been an increase in the popularity of darts as a household game.

One problem with such conventional sports-related dart games is their failure to adequately mimic the live action and complex interaction associated with the sports. Another problem with such conventional dart games is the lack of visual similarity to the specific aspects of the sport they are adapting.

Dart games have been used in combination with games such as football, golf and the like. While somewhat successful, there is still room for improvement. The inventor has noticed that automobile racing, specifically NASCAR, has grown immensely in popularity, and continues to grow. However, the inventor is not aware of any darts game that combines the game of darts with automobile racing.

Therefore, there is a need for a darts game that combines the game of darts with various features of automobile racing.

SUMMARY OF THE INVENTION

The above-discussed disadvantages of the prior art are overcome by a dart game that simulates an automobile race, such as NASCAR or INDYCAR. The players throw darts at a target board and follow instructions in areas of the target board according to where the dart landed. Each of the players has a game piece that is located on a scoreboard that is shaped to simulate a race track and is divided into a plurality of steps. The target board is also divided into a pit area. Each game piece is moved in accordance with the instructions found on the target board. A player can move in the track area only if his game piece is permitted on the track. A game piece is removed from the track if the player strikes an area on the target board that contains instructions which require the game piece to be moved into the pit. The player can only exit the pit if he has struck an area that has instructions that permit him to move out of the pits. The game continues until one player has completed a preset number of laps and crosses a start/finish line first.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Referring to the figures, it can be understood that the present invention is embodied in a dart game in which players toss darts, such as dart 12, at a target board 20 and, according to where the darts land, move game pieces, such as toy race cars, around a scoreboard 30. The target board as well as the scoreboard visually mimic a race track thereby increasing the visual enjoyment of the darts game embodying the teaching of the present invention. It is noted that the major areas of the target board can be designated by colors. For example, the racing area can be green, the pit area can be yellow and the area around the pit area can be brown or red. Furthermore, the target board as well as the scoreboard are each shaped in the manner of a race track. This adds visual aspects to the game.

Figure 1:
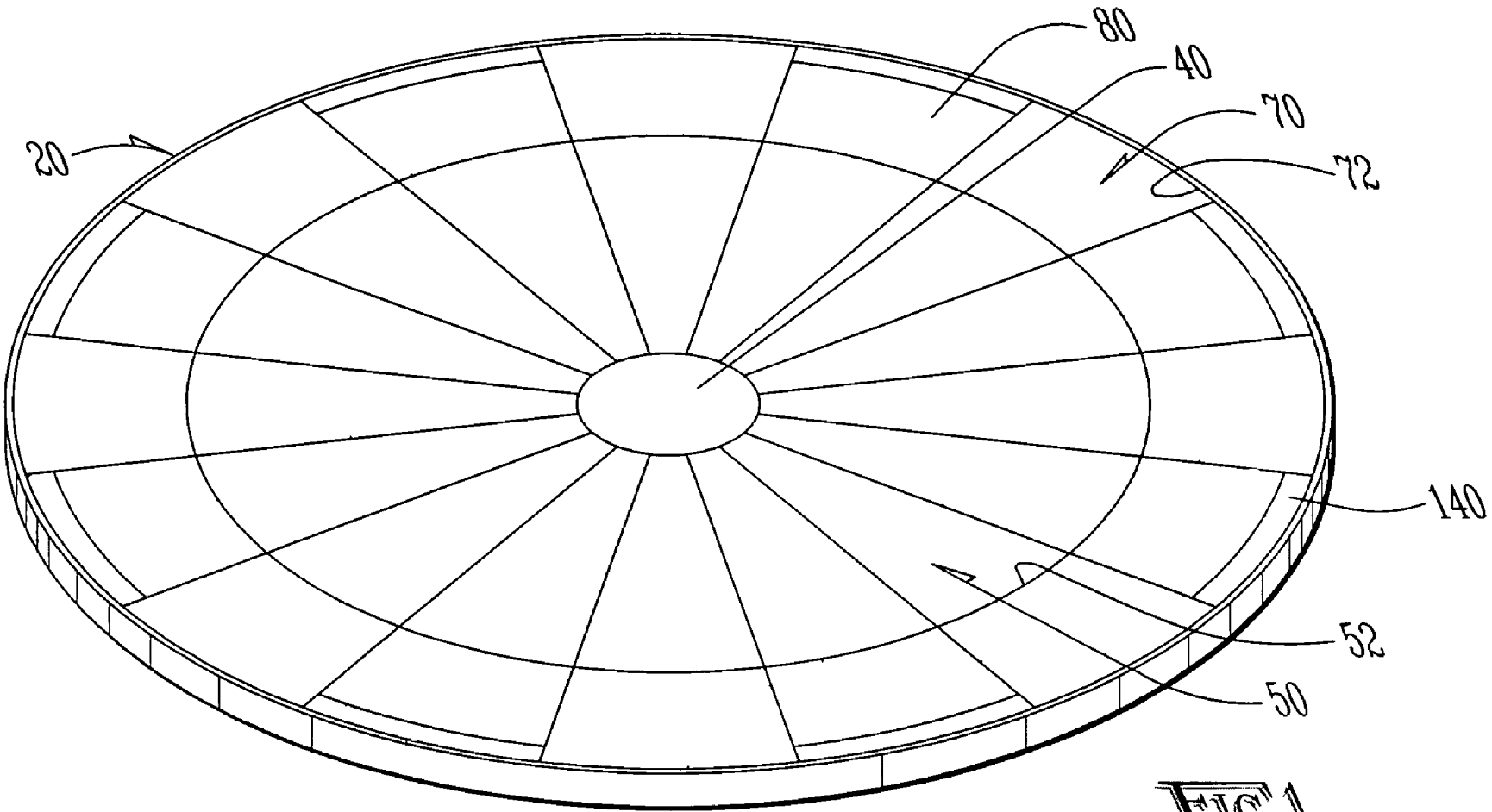
FIG. 1 is a perspective view of a target board used in the game embodying the principles of the present invention.
Figure 2:
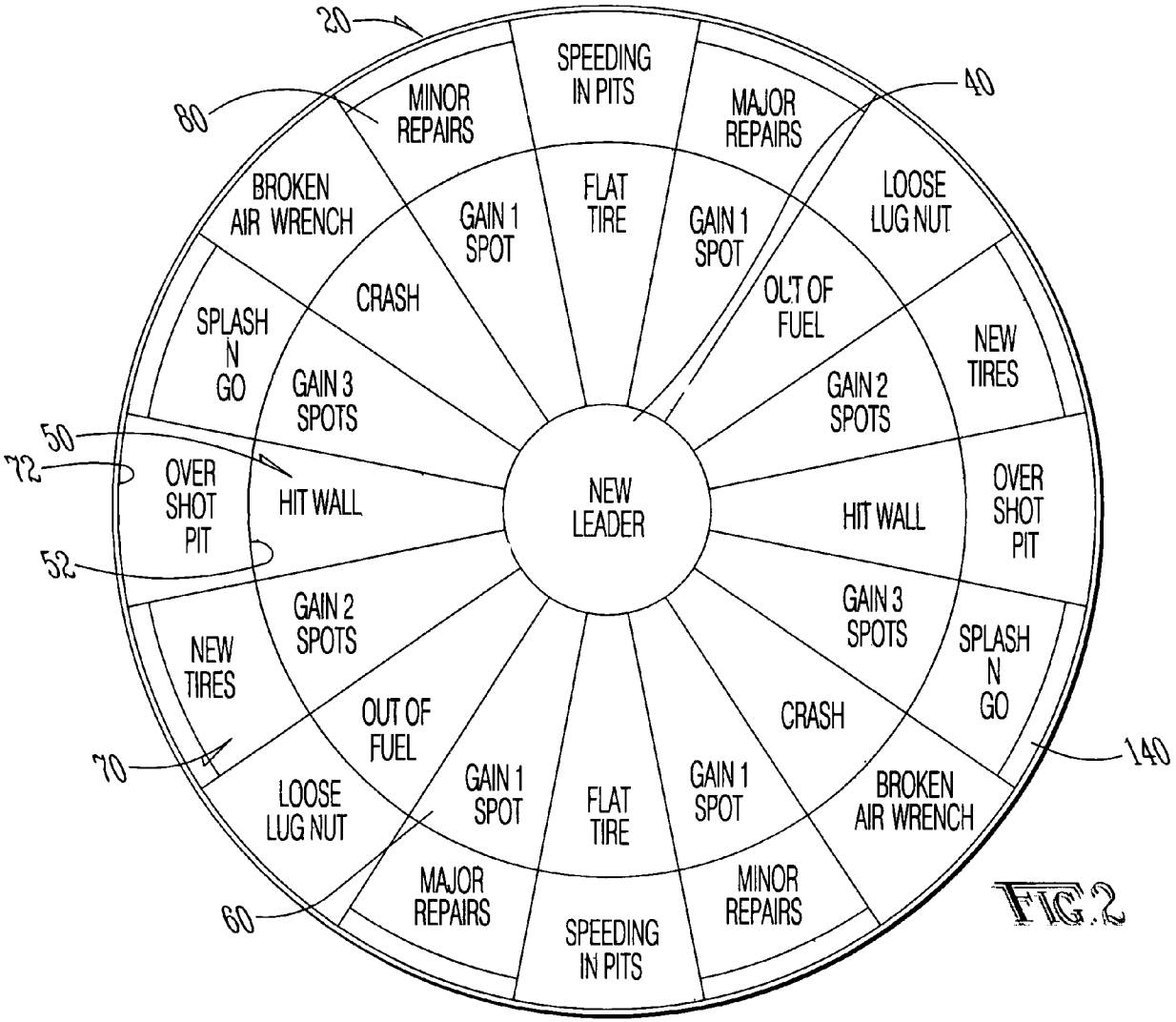
FIG. 2 is a plan view of the target board with target indicia in each location on the board.
Figure 3:
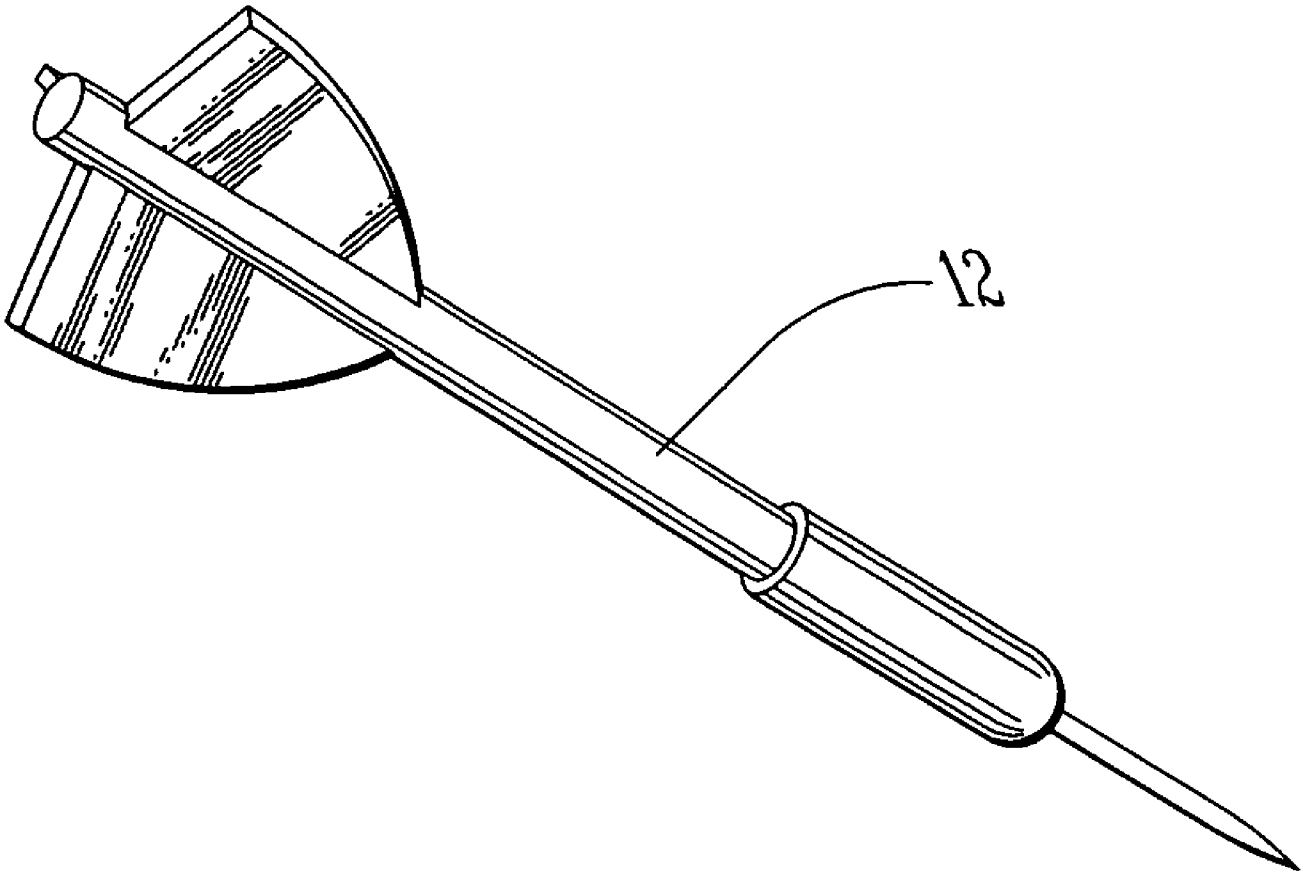
FIG. 3 is a perspective view of a dart used in the game embodying the present invention.
Figure 4:
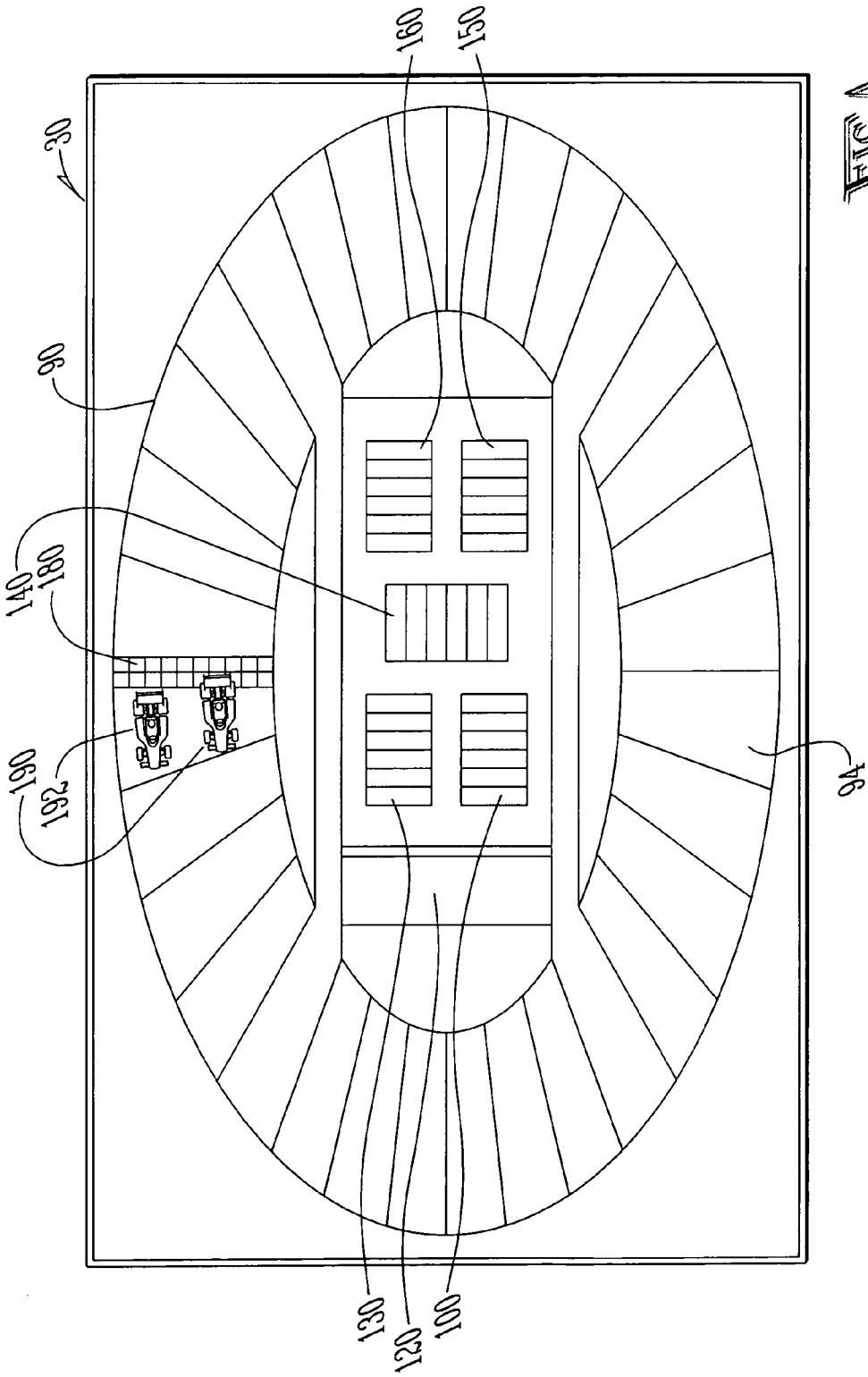
FIG. 4 is a plan view of a detailed scoreboard.

As can be understood from FIG. 4, the target board is divided into a plurality of target areas, such as a central bulls eye 40, a broad car movement area 50 which is defined by line 52 and which is circumscribed by that line, itself, and which is divided into a plurality of specific car movements, such as gain one spot 60, and a broad pit activity area 70 which is an annular area defined between lines 72 (and continuations thereof) and 52 and which is divided into a plurality of specific pit occurrences, such as minor repairs 80.

Each player has a toy car that is located on the scoreboard and is moved around track 90 in steps, such as step 94, according to the play of the game on the target board. Specific locations and activities can be recorded in player position locations, such as fuel location 100, tires area 130, other location 140, major repairs area 150 and minor repair area 160. The track has a start/finish line 180. Each player is assigned a playing piece, such as toy cars 190 and 192. These pieces are moved on the track shown on the scoreboard in accordance with the instructions on the target board. The instructions on the target board are selected by the players throwing darts at the target board and following the instructions in the area of the target board struck by the dart.

Play commences and continues according to the following steps:

All racing is done in the racing area 50 of the board. Any dart thrown outside the racing area is a wasted throw.

All pitting is done n the pit activity area 70 of the board. Any dart thrown outside the pit activity area is a wasted throw.

To qualify each player throws one dart. The dart that is to center of the board is the pole sitter, second closest is 2nd place and so on. The last place qualifier throws first in the game and the pole sitter throws last for the first round.

An example of play includes the following steps, with those skilled in the art will be able to understand how similar play will be carried out based on the teaching of this description: Player one throws 3 darts, each dart is scored as it is thrown. For example, if his/her first dart lands in the "gains one spot" area, this moves their car one spot on the scoreboard track while their player pin remains in the "on track" area; if the player's second dart lands in the "gains 2 spots" area, the player's car moves 2 more spots on the scoreboard track; and if, for example, dart 3 lands in the "gains 3 spots area" that player's car moves 3 more spots. The player's turn is now over.

The second player, for example, can repeat what the first player did, or he can try throwing for the "new leader" bulls eye. If he hits it, the player's car is moved to one spot in front of the lead car and becomes the new leader of the race. There is no need to throw another dart at the 'new leader" bulls eye as this will gain nothing. The player then throws a second dart, if the player's second dart misses a "gain" spot an, for example, lands in the 'fiat tire" area, that players "pit pin" is moved from the "on track area" 120 to the "tires' area 130 in the pit box. The player must now use his remaining dart to try hit the target titled "new tires" in order to fix the flat tire. Until the player hits the "new tires" target area, he remains in place and cannot move his car on the scoreboard target. Once the flat is fixed the player's "pit pin" is moved from the "tires box" to the "on the track" box and the player can resume racing. Until such time, however, the player's pit pin will remain in the "tires" box and his car cannot advance on the track until he exits the pits.

While in the pits, while tossing the darts on his turn in an effort to hit a target area that will allow him to return to the track and to racing, a player can run into more trouble such as speeding in the pits, over shooting the pit, broken air wrench, and loose lug nuts. Each of these infractions will require yet another pit stop. If the player was in the pits for a "major repair" his/her "pit pin' would be moved clown to the second level of the "major" box. Any "pit" will fix these extra infractions, so even if player was throwing for a major repair and hit a "new tire" he/she would move their "pit pin" up one level in the "major" box. The area 140 on the outside of the pits counts as 2 pits, each of which will allow the player to exit the pits and return to racing.

Play continues until a car passes the start finish tine on the final lap and the pole sitter has had his her last throw. The number of laps can be set by player agreement prior to the start of the game.

A player is never out of the game even if he spent the whole race in the pits. As long as the player is on the track for the final throw, that player can always go for the "new leader' bulls eye and win.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A method of playing a darts game comprising:

A) establishing that the darts game will simulate an automobile race;

B) providing a target game board and a scoreboard, and providing a start/finish line on the scoreboard;

C) dividing the target game board into a major section for racing and a major section for pitting, and subdividing the major section for racing into a plurality of subsections and placing car movement instructions in each subsection of the major section for racing, providing a bullseye which instructs a player to become a leader, and subdividing the major section for pitting into a plurality of subsections and placing car repair instructions in each subsection of the major section for pitting;

D) providing a special pit section adjacent to the major section for pitting;

E) establishing a set number of laps which must be completed by a winner;

F) each player throwing a dart at the target board and attempting to hit the bullseye section of the major section for racing;

G) designating the player who's dart is closest to the bullseye as a pole sitter;

H) the players taking turns in reverse order so that the pole sitter throws last and the player who's dart landed farthest from the bullseye being designated as the player taking the first turn;

I) each player, in turn, throwing three darts at the target board and attempting to hit a subsection containing car movement instructions;

J) each player moving a game piece in accordance with instructions contained in a target area struck by the player's dart; and H) designating the player who's car moves across the finish line first after completing a predetermined number of laps as the winner.

2. The method of playing a darts game defined in claim 1 further including requiring a player who's dart has struck a section of the target board containing pitting instructions to hit a section with instructions to leave the pit area before permitting that player to continue moving his game piece.

3. The method of playing a darts game defined in claim 2 further including a step of designating a player who's dart struck the bullseye as the leader.

4. The method of playing a darts game defined in claim 3 further including a step of allowing each player to throw three darts on each turn.

5. The method of playing a darts game defined in claim 4 further including a step of placing instructions to gain one spot in one of the subsections of the major section for racing.

6. The method of playing a darts game defined in claim 5 further including a step of placing instructions to crash in one of the subsections of the major section for racing.

7. The method of playing a darts game defined in claim 6 further including a step of placing instructions to be out of fuel in one of the subsections of the major section for racing.

8. The method of playing a darts game defined in claim 7 further including a step of placing instructions to have a flat tire in one of the subsections of the major section for racing.

9. The method of playing a darts game defined in claim 8 further including a step of placing instructions to conduct minor repairs in one of the subsections of the major section for pitting.

10. The method of playing a darts game defined in claim 9 further including a step of placing instructions to conduct major repairs in one of the subsections of the major section for pitting.

11. The method of playing a darts game defined in claim 10 further including a step of placing instructions to place new tires on the car in one of the subsections of the major section for pitting.

12. The method of playing a darts game defined in claim 11 further including a step of placing instructions to get out of the pit in one of the subsections of the major section for pitting.

* * * * *